United States Patent [19]

Patton

[11] Patent Number: 4,823,567

[45] Date of Patent: Apr. 25, 1989

[54] PADLOCK AND LOCKING MECHANISM

[76] Inventor: Victor L. Patton, 13435 Allison Ranch Rd., Grass Valley, Calif. 95949

[21] Appl. No.: 182,495

[22] Filed: Apr. 18, 1988

Related U.S. Application Data

[62] Division of Ser. No. 33,828, Apr. 3, 1987, Pat. No. 4,748,832.

[51] Int. Cl.[4] ..... E05B 67/22

[52] U.S. Cl. ..... 70/38 A; 70/38 C; 70/39

[58] Field of Search ..... 70/20, 31, 35, 38 R, 70/38 A, 38 B, 38 C, 3 P

[56] References Cited

U.S. PATENT DOCUMENTS 1,384,590 7/1921 Bottone .
1,424,543 8/1922 Wiloch ..... 70/39
1,718,723 6/1929 Williams .
1,902,665 3/1933 Reinhold ..... 70/39
4,064,716 12/1977 Shwayder et al. .
4,085,600 4/1978 Bindari .
4,308,845 8/1979 Szpakman .

FOREIGN PATENT DOCUMENTS 335229 3/1921 Fed. Rep. of Germany ..... 70/20

*Primary Examiner*—Robert L. Wolfe
*Attorney, Agent, or Firm*—Leonard Bloom

[57] ABSTRACT

A padlock having a "U" shaped shackle, a main body having an opening to receive at least one leg of the shackle, the main body having an interior which defines a recess within which a lock bolt body can be threadedly admitted, the lock bolt body having one catch to engage at least one leg of the shackle. A key rotates the lock bolt body between a locked, an unlocked, and a diassembled position.

10 Claims, 4 Drawing Sheets

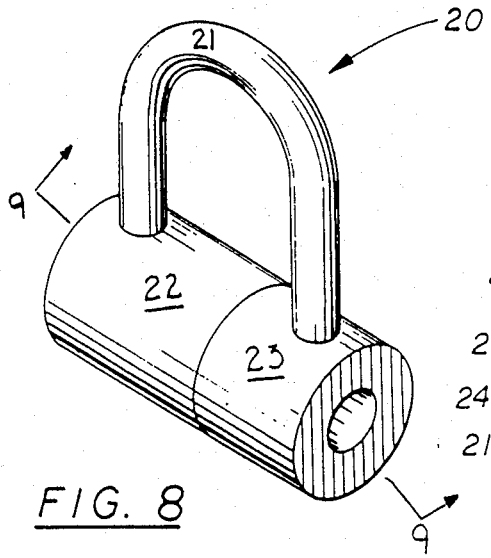
FIG. 8
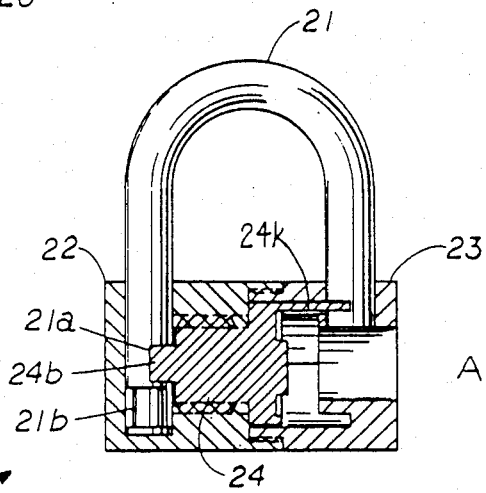
FIG. 9
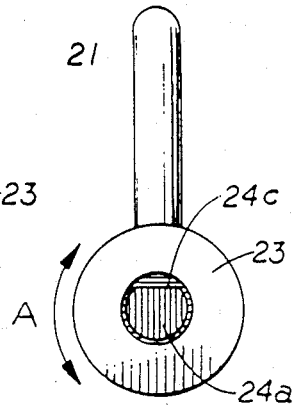
FIG. 10
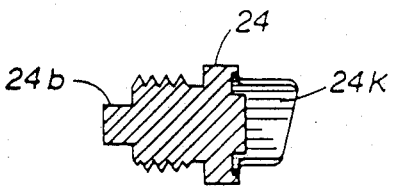
FIG. 11
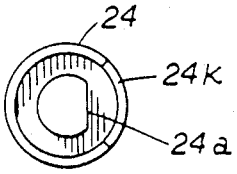
FIG. 12
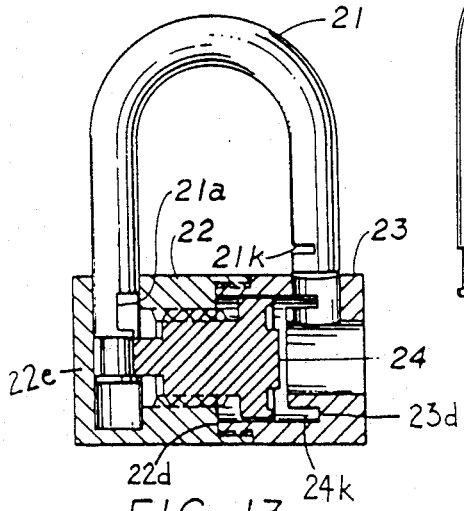
FIG. 13
FIG. 14
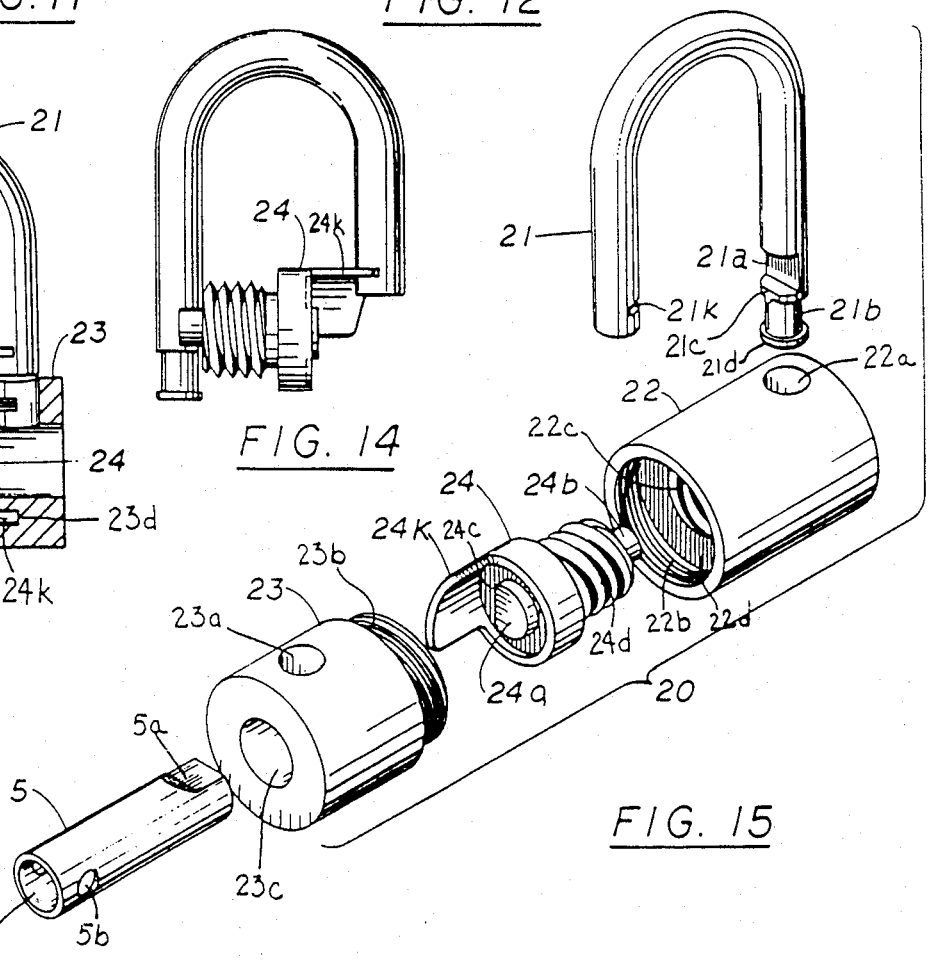
FIG. 15

PADLOCK AND LOCKING MECHANISM

This application is a division of application Ser. No. 033,828, filed Apr. 3, 1987, now U.S. Pat. No. 4,748,832.

FIELD OF THE INVENTION

The following invention relates generally to an improved padlock. More particularly, the invention contemplates providing a device which is negligibly adversely affected by wear, climate and hostile environments which disable prior art devices.

BACKGROUND OF THE INVENTION

While padlocks serve many useful purposes with respect to preventing theft, vandalism or tresspassing, certain difficulties may arise when using known prior art devices which, if frequently encountered can be both nettlesome and time consuming.

Considering padlocks which are key operated, most commercially available padlocks are operated through a series of pins which are spring biased to enable a key. The lock mechanism itself may also include spring biasing to removeably connect the lock shackle to the main body of the lock. Under ideal circumstances, these lock provide durable and efficient service, but ideal circumstances are not always the rule, but rather the exception.

When the lock is exposed to inclement weather and/or is exposed to hostile environments such as corrosive salts or other contaminants, the lock mechanism is frequently disabled. For example, lock mechanisms frequently collect condensation which, when frozen, disable the lock. Alternatively, salt commonly used to prevent highway icing can cause corrosion and rust when it enters the lock having an adverse effect on the lock operating mechanism. Other contaminants such as soot, dust or other particulate matter can also adversely effect reliable operation of the lock.

Changes also occur in many locks as a function of time. Many locks use spring biasing and over a period of time, the spring may lose its originally engineered value. Loss of lubrication as a function of time will cause parts which once moved freely to become frozen.

These problems are magnified enormously when one has in his care and custody a plurality of locks to which one must gain access. Apart from the difficulties associated with matching one key for each lock, or more simply one master key for a series of locks, failure of the lock itself is a surprisingly common occurance. One expeditious method of overcoming a failed lock is to use bolt cutters, but obviously the lock must thereafter be replaced which would be a needless expenditure if the lock continued to work reliably.

Assume that a utility company protects access to certain power transmission equipment not only from thieves, vandals, and trespassers but also from the possibilities of tort liability. The number of locks in use grows to substantial levels, and the need for access to electrical equipment such as during a power failure places a premium on the utility company's representative to effect repairs expeditiously. The common solution therefore, is to replace an old malfunctioning lock with a new one.

The following patents reflect the state of the art of which applicant is aware insofar as they appear relevant to the patent process. In addition, these patents are cited in direct response to applicant's acknowledged duty to disclose prior art.

| INVENTOR(S) | PATENT NUMBER |
|---|---|
| Bindari | 4,085,600 |
| Bottone | 1,384,590 |
| Shwayder, et al | 4,064,716 |
| Szlakman | 4,038,845 |
| Williams | 1,718,723 |
| Wiloch | 1,424,543 |

Wiloch makes it known to provide a padlock in which a screw plug is threaded for engagement with threads 5 of barrel 1 to allow a pin 8 to engage a shackle bolt. For operation, this patent provides a spring pressed plunger 19 which shows the difficulty of all other known spring biased lock mechanisms discussed hereinabove.

Similarly, the patent to Williams provides a padlock in which it is known to provide a spring F for use in selective engagement of the shackle with respect to the padlock body.

Szlakman provides a security appuratus in which the active elements are spring biased FIG. 5, reference numeral 111).

The remaining citations commonly share double contact locking features in which a tubular shaft having cutaway portions is rotated within a lock body to selectively engage notches on either of the shackle legs. The lock mechanism is substantially in the same place as the plane of the shackle.

SUMMARY OF THE INVENTION

The instant invention is distinguished over the known prior art, whether considered singularly or in any conceivable combination in that the lock mechanism is enabled merely by rotation of a threaded body within a threaded bore to alternatively lock or unlock the padlock. An uncommon drive head allows rotation of the threaded body and substantial mechanical advantage can be brought to bear on the padlock along the threaded area to minimize the likelihood of the lock malfunctioning. The entire operating mechanism is merely the thread between the body and its associated housing, and so the likelihood of component failure is minimal.

More specifically, a padlock is provided which includes a main body having an end cap which encloses therewithin a lock bolt body which is operated by a key. A "U" shaped shackle having first and second legs, one leg longer than the other, is formed such that one leg is received within the main body and another leg is received by the end cap. Other forms of lock bolt body are provided with corresponding modification to the shackle in which either one or both legs can be secured to provide the lock effect.

In some forms of the invention, the longer shackle leg includes three positions: a first position where the leg is constrained from axial translation defining a locked padlock position, a second unlocked position where the leg is free to translate axially within a limited range of motion, and then is configured to promote rotation about the longitudinal axis of the longer leg, and finally a third, disassembled position where the longer leg can be removed entirely from the main body.

The first two embodiments differ with respect to the shorter leg. In one form, the shorter leg is not provided with an engagement with the end cap within which the shorter leg is admitted. With another embodiment, the shorter leg can be fixidly held within the end cap. Thus, two different lock bolt bodies are provided. In both these embodiments an external thread coacts with the main lock body and when only one leg is to be engaged, an end of the lock bolt body captures the longer leg to achieve any of the three positions defined hereinabove. When both legs are to be retained, another end of the lock bolt body is provided with a cam which engages the shorter leg upon rotation of the lock bolt body.

In two other forms of the invention, the means for fixing the legs of the shackle within the main body of the lock is configured as a lock bolt body which threads within the main body wherein the lock bolt body passes between each leg of the shackle thereby advancing in along an axis perpendicular to the plane of the shackle.

OBJECTS OF THE INVENTION

Accordingly, it is a primary object of this invention to provide a new and novel padlock.

It is yet a further object of this invention to provide a device as characterized above which has few moving parts and no parts such as springs or pins which lose their design values as a function of time and detrimentally affects lock operation.

It is yet a further object of this invention to provide a padlock as characterized hereinabove in which the shackle orients into one of three positions: a locked position wherein both legs of the shackle are contained within the main body and cap assembly of the padlock, a second position wherein the padlock is unlocked yet one leg is retained within the main body of the padlock, and a third position in which the shackle is completely removed and separated from the main body and cap.

It is yet a further object of this invention to provide a device as characterized above which is relatively impervious to the ravages of the environment.

A further object of this invention is to provide a device as characterized above which is extremely simple in operation, lends itself to mass production techniques, and which has extremely few moving parts for durability and reliability in service.

It is a further object of this invention to provide a padlock which includes a shackle having a long and short leg, shackle receiving means having a lock means threaded therewithin, having a catch at one end to engage the long leg and a cam at an opposite end to engage the short leg whereby rotation of the lock means causes axial translation thereof with respect to the shackle leg receiving means due to the threads to thereby lock and unlock the padlock by retaining or freeing the legs.

It is a further object of this invention to provide a padlock characterized in that a shackle having a generally "U" shaped configuration includes a long leg having at a free end thereof a flange which underlies an annular portion which, in turn, underlies a cam shelf which, in turn, is spaced below a notch on the long leg, and a padlock main body having an opening therein to receive the long leg of the shackle and lock means within the main body to engage the long leg either at the notch, thereby locking the long leg, at the annular portion, thereby allowing the long leg to rotate about the longitudinal axis, or to removeably free the long leg by having the lock means clear the flange, thus defining three positions.

It is yet a further object of this invention to provide a device in the environment of padlocks in which the improvement comprises a main body threadedly connected to an end cap which collectively define means for receiving shackle legs, an internal thread on the main body to receive a threaded lock bolt body therein, and the lock bolt body has means to fixidly retain at least one shackle leg when the lock bolt body is axially advanced by rotation of the lock bolt body with respect to the threads on the main body.

It is yet a further object of this invention to provide a padlock characterized in that a shackle having "U" shaped configuration and defining a plane reciprocates within a shackle receiving body, and a lock bolt body advances within the main body in a direction perpendicular to the plane of the shackle, the lock bolt body cooperating with the main body through threads.

These and other objects will be made manifest when considering the following detailed specification taken in conjunction with the included drawing figures.

BRIEF DESCRIPTION OF THE DRAWING FIGURES

FIG. 8 is a perspective view similar to FIG. 1 of a second form of the invention.

FIG. 9 is a sectional view taken along lines 9—9 of FIG. 8.

FIG. 10 is one end view of that which is shown in FIG. 8.

FIG. 11 is a sectional view of a lock bolt body shown also in FIG. 9.

FIG. 12 is one end view of that which is shown in FIG. 11.

FIG. 13 is a sectional view similar to FIG. 9, but shown in a second unlocked position.

FIG. 14 is a non-sectional, side view of the locking mechanism shown in FIG. 9.

FIG. 15 is an exploded parts view in perspective of all components forming the second embodiment in a third disassembled position.

BRIEF DESCRIPTION OF THE PREFERRED EMBODIMENT

Figure 1:
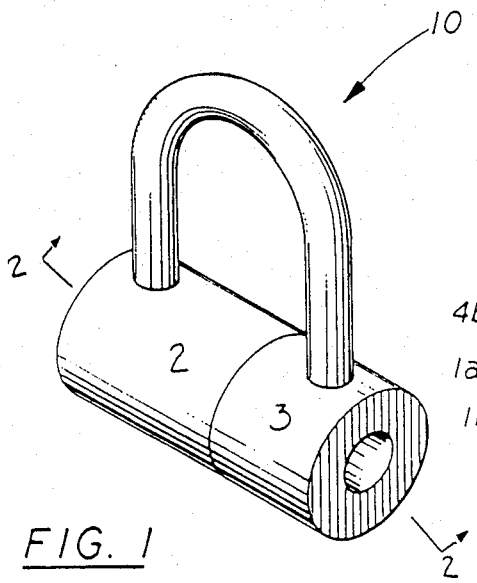
FIG. 1 is a perspective view of the apparatus in one form, according to the present invention.

Referring to the drawings now, wherein like reference numerals refer to like parts throughout the various drawing FIG.s, reference numeral 10 (FIGS. 1–7) is directed to the padlock according to one form of the invention.

In its essence, the padlock 10 includes a substantially "U" shaped shackle 1, having pair of downwardly extending legs, both of which fit within bores respectively of a main body 2 and an end cap 3. The main body 2 and end cap 3 are co-joined yet separable through threads which allow a lock body 4 to be received therewithin. A key 5 operates the lock body 4 allowing the shackle to assume one of three positions: the lock position of FIG. 1, the unlocked position of FIG. 6, and the disassembled position of FIG. 7.

Figure 7:
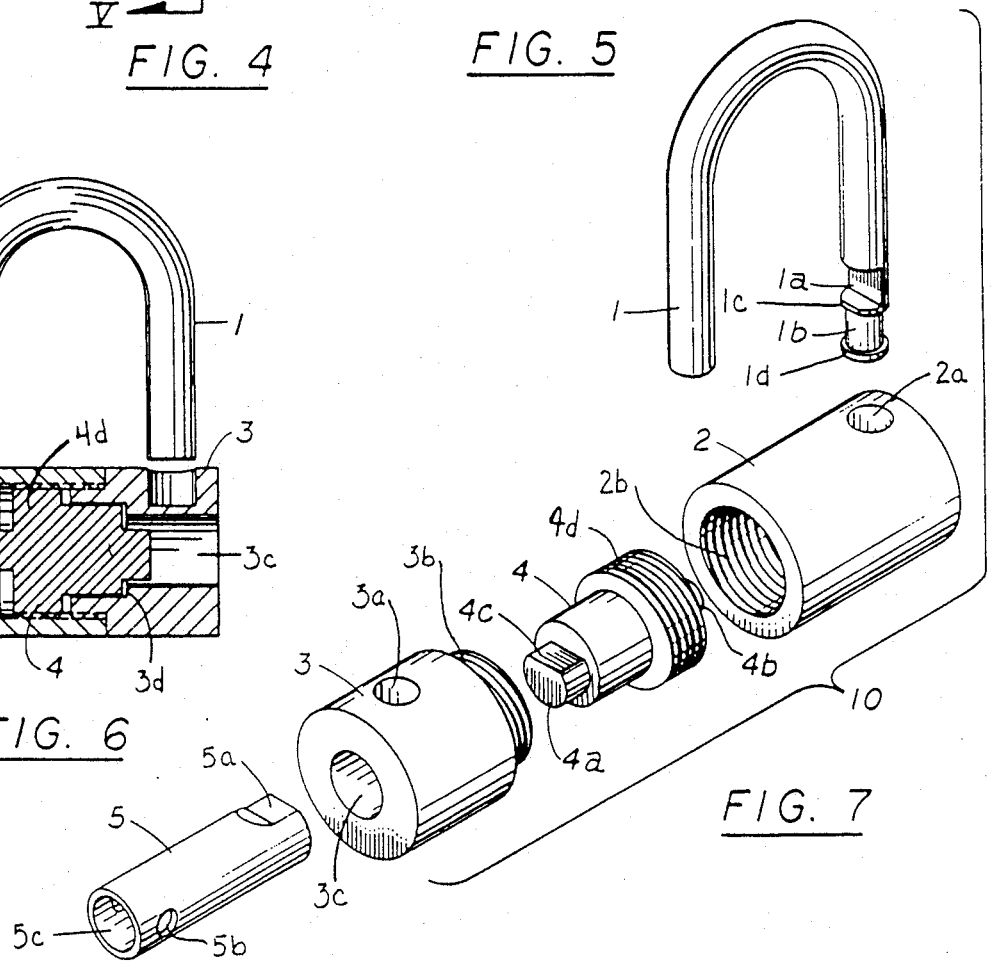
FIG. 7 is an exploded parts view in perspective of the entire apparatus disassembled, showing the shackle leg in a third position.
Figure 16:
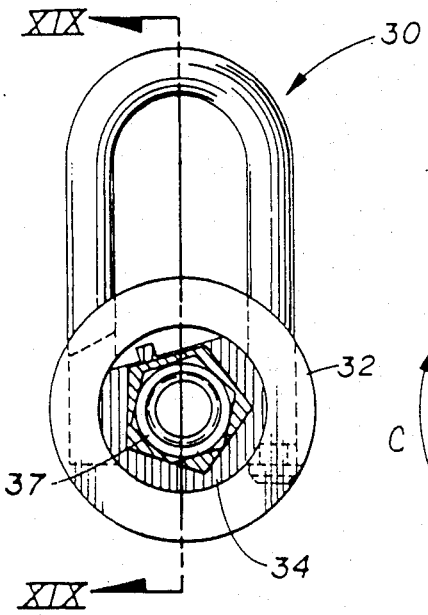
FIG. 16 is an end view of a third form of the invention.

More particularly, and with reference to FIG. 7, the "U" shaped shackle 1 includes a short leg and a long leg interconnected by an arcuate bight portion. The longer leg includes at a free end thereof, a flange 1*d* which is substantially annular in configuration. Immediately above the flange 1*d*, a cylindrical portion 1*b* is provided, and immediately thereabove, a cam shelf 1c is formed which lies just below a notch 1*a*.

Figure 2:
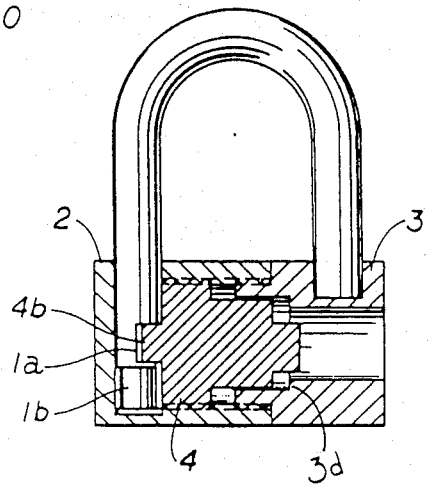
FIG. 2 is a sectional view taken along lines 2—2 of FIG. 1.
Figure 6:
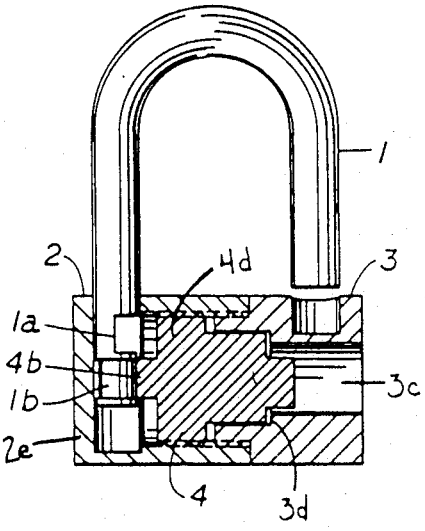
FIG. 6 is a sectional view similar to FIG. 2, showing the lock in a second unlocked position.

The free end of the longer leg coacts with a catch 4*b* of the lock bolt body 4 to define one of the three possible positions for the shackle 1. When the catch 4*b* resides against the notch 1*a* and above the cam shelf 1*c*, the padlock is in a closed, locked position such as shown in FIGS. 1 and 2. Backing the lock bolt body 4 gradually away from the notch 1*a* provides clearance to go below the cam shelf 4*c*. Cam shelf 4*c* has a flattened surface on the same side of the longer leg as the notch, so that the shackle 1 can be moved axially along the length of the longer leg and the catch 4*b* can now reside along the cylindrical portion 1*b* of the longer shackle leg. This defines a second unlocked position shown in FIG. 6. Note the flange 1*d* retains the shackle within the main body 2. To completely remove the shackle from main body 2, the lock bolt body 4 must be backed away even further to allow clearance for the shackle longer leg and its flange 1*d* to pass beyond the catch 4*b*. Note the presence of stop member 3*d* on the end cap 3 which controls the amount of axial translation for the lock bolt body 4 under normal circumstances (FIG. 6).

As shown, the lock bolt body 4 is contained in a main body 2 having an end cap 3. More particularly, the main body 2 is a substantially cylindrical sleeve having a threaded central bore 2*b* and a hole 2*a* oriented to receive the longer leg of the shackle 1. Note that the main body has a wall 2*e* which closes one end of the main body thereby defining a blind bore.

Figure 3:
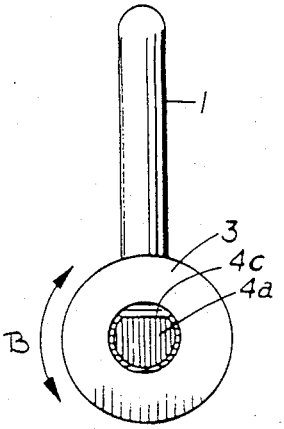
FIG. 3 is one end view of that which is shown in FIG. 1.
Figure 4:
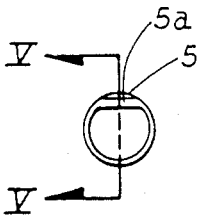
FIG. 4 is an end view of a key which operates the padlock having access along the end shown in FIG. 3.
Figure 5:
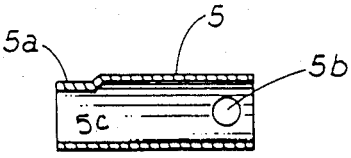
FIG. 5 is a sectional view taken along lines 5—5 of FIG. 4.

An end cap 3 is provided with a threaded end 3*b* having a thread pitch complimental to the thread 2*b* of the main body 2 so that the end cap 3 can be removeably attached to the main body 2 by rotation as per arrow "B" (FIG. 3). The threaded central bore 2*b* of the main body 2 is large enough to accomodate the lock bolt body 4 therewithin and be contained within the bore by means of the end cap 3 and its internal stop 3*d*.

The lock bolt body 4 is of substantially cylindrical configuration and has a portion dimensioned to be received within the end cap 3. The body 4 includes a plurality of threads 4*d* on an outer surface thereof dimensioned to engage the threaded central bore 2*b* of the main body 2. When assembled, the lock bolt body 4 is first threaded within the main body 2 so that the catch 4*b* for the long leg is proximately disposed with respect to the hole 2*a* for the long leg, and the end cap 3 is threaded within the bore 2*b* of the main body to capture the lock bolt body 4 within the interior of the main body 2 and cap 3. As mentioned, the end cap interior includes a stop 3*d* defined as a necked down area to serve as an abutment which controls the amount of axial translation possible for the lock bolt body 4 by stopping translation of the lock bolt body 4 away from the longer leg of the shackle 1.

The end cap 3 further includes a hole 3*a* to receive the shorter leg of the "U" shaped shackle 1. The cap 3 also includes an axially disposed key hole 3*c* on an end of the cap 3 remote from its threaded attachment to the main body 2.

This key hole 3*c* receives a key 5 having one end 5*a* defined as a coded socket which overlies a key driven coupling 4*a* on an end of the lock bolt body to rotate the body. As shown, a coded key receiving surface 4*c* is embodied as a flattened area on an otherwise annular surface, but it should be clear that different codes could be applied to render selective admission to the operating mechanism of the padlock 10. Thus, star shaped, hexagonal, octagonal or other external contours can selectively preclude admission for operating the padlock. The key 5 is substantially tubular in configuration having a hollow core 5*c* and a hole 5*b* to receive a key ring or the like to carry the key conveniently.

In use and operation, to assemble the lock, the shackle 1 is first placed in the hole 2*a* and the lock bolt body 4 is threaded wherein the bore 2*b* of the main body 2 so that the catch 4*b* will engage the cylindrical portion 1*b* of the shackle longer leg. Next, the end cap 3 is threaded within the main body. The padlock threads 2*b*, 4*d* and 3*b* are machined so that the short leg hole 3*a* is in alignment with the long leg hole 2*a* (on the same side of the combined end cap 3 and main body 2 so that the shorter shackle leg can be placed within hole 3*a*). The lock can be thereafter enabled by pressing the shackle downwardly so that the short leg is contained within the hole 3*a*. The key 5 rotates the lock bolt body 4 to engage notch 1*a* thereby locking the padlock. The padlock is unlocked by reversing the operation of the key 5 until the lock bolt body 4 abuts stop 3*d*. Since the lock operating mechanism is solely the threaded outer surface 4*d* with the threaded central bore 2*b*, a very reliable lock has been provided that is substantially impervious to the ravages of the environment, such as corrosive road salt, condensation, insects, and temperature change. To disassemble, the end cap is unthreaded as shown by arrow "B".

Reference is now made to FIGS. 8 through 15 which teach the use of a padlock 20 which differs from the padlock 10 essentially in that the short leg of the "U" shaped shackle 21 includes a notch 21*k* which is captured by a cam 24*k* contained on the lock bolt body 24. Thus, in this embodiment, the bolt 24 retains both legs of the shackle 21.

As before, the longer leg of the shackle 21 includes a notch 21*a*, a cylindrical portion 21*b*, a cam shelf 21*c*, and a flange 21*d* operating similar to the embodiment for padlock 10. The short leg, however, as mentioned, has a notch 21*k*. This notch 21*k* coacts with the lock bolt body 24 which is conFIG.d as follows.

A catch 24*b* for the long leg is provided similar to the first embodiment, as is a key driven coupling 24*a* and a coded key surface 24*c*. The bolt body 24 includes a threaded outer surface 24d which in this embodiment is of lesser diameter than the diameter of the lock bolt body 24 and as compared with FIG. 7. In addition, the lock bolt body 24 includes a cam catch 24k which extends from the end of the lock bolt body 24 remote from the catch 24b for the long leg. The cam 24k is fashioned as an arcuate sleeve which can move from a first locked position (FIG. 9) to a second unlocked position (FIG. 13) to engage or release respectively the short leg of the shackle 21.

In addition, the main body 22, while including a hole 22a for the long leg, a threaded central bore 22b for the end cap 23 and a wall 22e which seals off the bore, also has further differences to accomodate the lock bolt body 24. As shown in FIG. 15, a radially extending wall 22d provides a stop for the lock bolt body 24 and includes a central opening in which a threaded smaller bore 22c extends further within the main body 22. The smaller bore threads 22c coact with the threaded outer surface 24d of the lock bolt body 24 to provide the locking and unlocking effect for both legs of the shackle 21.

In addition, the end cap 23, while including a hole 23a for the short leg, a threaded end 23b and an axially extending key bore 23c, also includes an internal clearance 23d, which provides room for the cam catch 24k of the shorter leg. This clearance 23d in the form of an annular groove provides a stop similar to the stop 3d of the end cap 3 to limit the amount of axial translation of the lock bolt body 24.

In use and operation, the shackle 21 is placed within the hole 22a of the main body 22, the lock bolt body 24 is advanced by threading within the threaded bore 22c and 24d so that the catch 24b engages the cylindrical portion 21b of the shackle. The end cap 23 is threaded via threads 23b into the main body 22 via threads 22b, so that the short leg hole 23a can register with the short leg and the lock can be fixed by depressing the shackle leg down and rotating the lock bolt body 24 with a key 5 similar to the key of the first embodiment. As before the end cap 23 is advanced on the main body 22 by rotation as per the arrow "A".

Attention is now directed to FIGS. 16 through 19 which show a third version of a padlock 30. The padlock 30 includes a main body 32 which carries first and second openings 32a to receive legs of shackle 31. The body 32 has an integrally formed end wall 32e which supports a centrally disposed threaded shaft 32b extending along a central longitudinal axis of the body 32.

Figure 17:
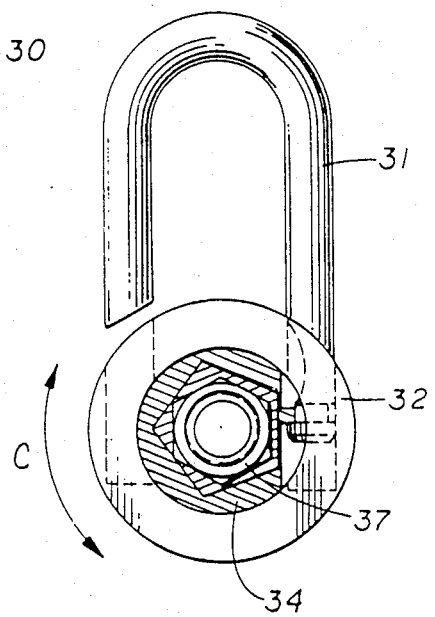
FIG. 17 is a similar end view of that which is shown in FIG. 16 in an unlocked position.
Figure 18:
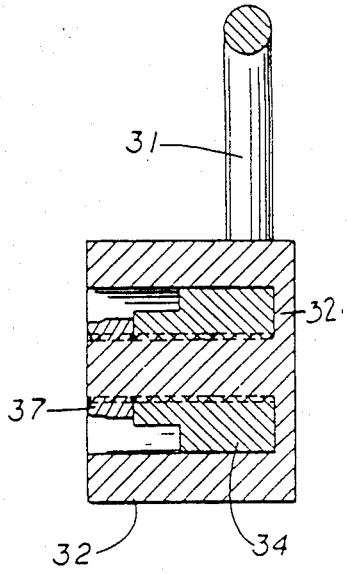
FIG. 18 is a sectional view taken along the lines shown in FIG. 16.
Figure 19:
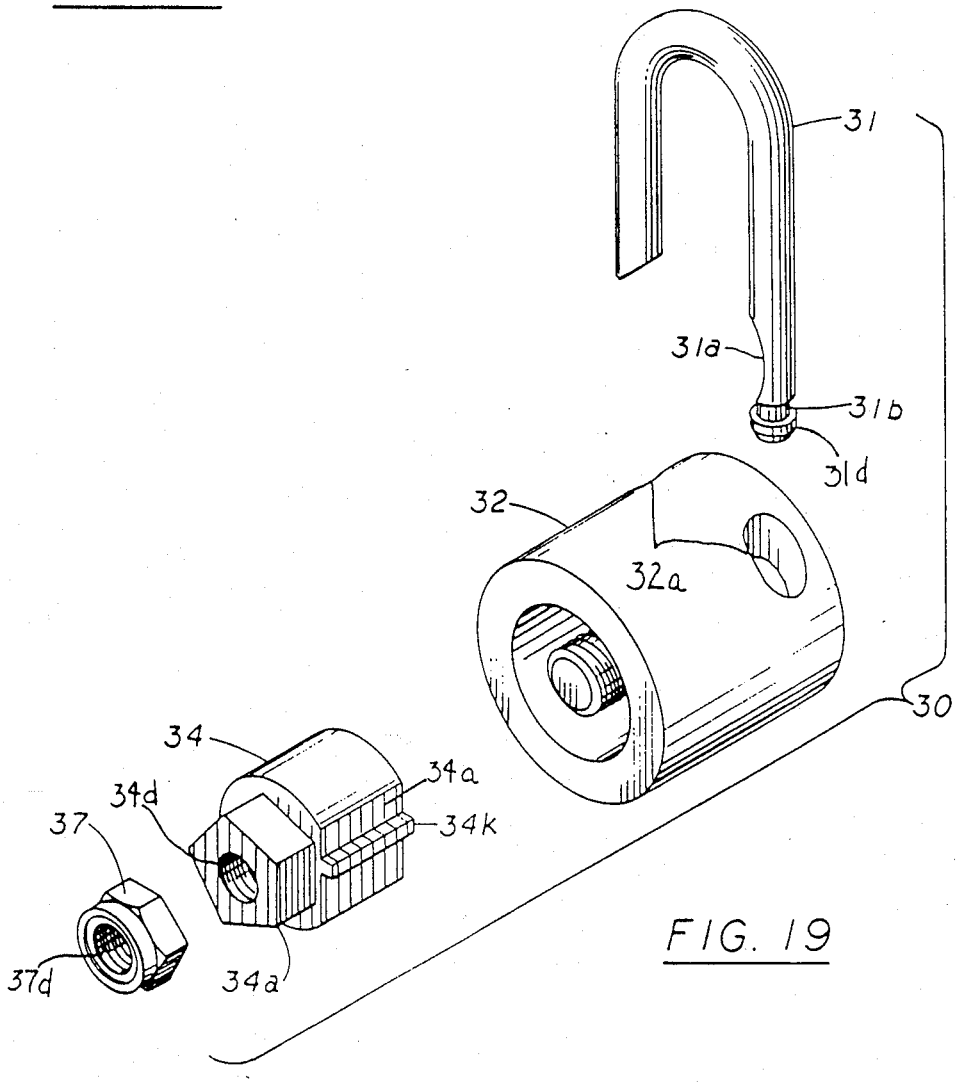
FIG. 19 is an exploded parts perspective view of the third embodiment.

Clearance is provided between the shaft 32b and the main body's inner annular surface to receive therein a lock bolt body 34 having a central bore 34d provided with an internal thread complimental to the threaded shaft 32b of the main body 32. A specially coded coupling 34a is placed on an outer face of the lock bolt body 34 for access by a user of the lock. In use, the lock bolt body 34 is advanced on the shaft 32b where it can engage a long leg of the "U" shaped shackle 31. More particularly, the shackle 31 includes a short leg and a long leg, the latter having arcuate cutaway 31a which faces the shorter leg and immediately therebelow, a cylindrical portion 31b followed in turn by an annular flange 31d at a free end of the longer leg. When both legs of the shackle are placed within the holes 32a of the main body 32, and the lock bolt body 34 is advanced to abut against the end wall 32e, the annular outer surface of the lock bolt body 34 rides within the arcuate cutaway 31a of the longer shackle leg to fix the shackle within the main body 32. See FIG. 16. The lock bolt body 34 also includes on an outer wall thereof a longitudinally extending flattened portion 34a which supports a catch 34k which is shown in FIG. 17 operates to engage the annular portion 31b of the shackle leg which, by virtue of its proximity to the flange 31d precludes removal of the shackle from the body when the shackle is unlocked. To facilitate the locking and unlocking of this version without close inspection as to the placement of the catch 34k, a lock nut 37 having an internal thread 37d is strategically placed on the threaded shaft 32b to control in most circumstances the amount of axial translation of the lock body 34 to define the clearance for allowable axial translation of the lock bolt body 34. That is, within the clearance permitted by the lock nut 37, when the lock bolt body 34 is advanced to either extreme permitted by the lock nut, the two positions shown in FIGS. 16 and 17 will be effected. Complete removal of the shackle 31 will therefore necessitate partial or total withdrawal of the lock nut 37. Note that the locking is effected by advancement of the lock bolt body along an axis perpendicular to the plane of the shackle.

Figure 20:
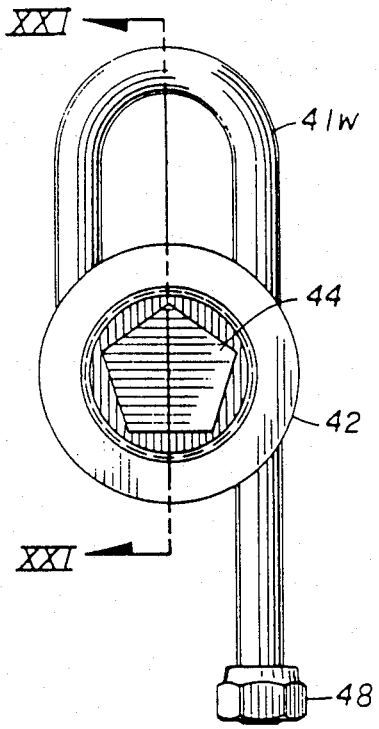
FIG. 20 is an end view of a fourth embodiment according to the present invention.
Figure 21:
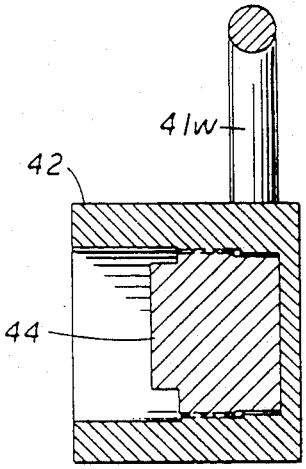
FIG. 21 is a sectional view taken along lines 21—21 of FIG. 20.
Figure 22:
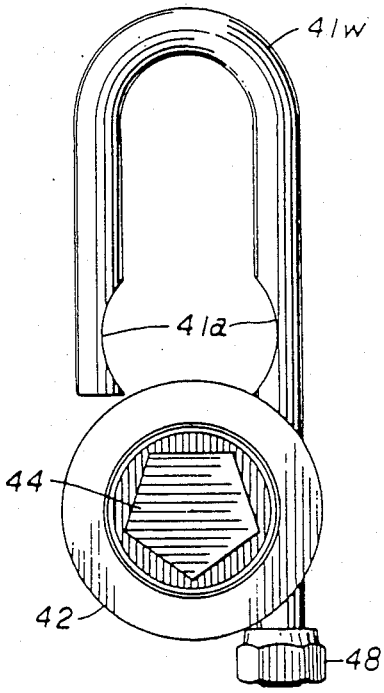
FIG. 22 is an end view similar to FIG. 20 showing a second position.

FIGS. 20 through 22 show a mechanism similar to the last named embodiment, particularly with respect to the axial advancement of the lock bolt body perpendicular to the plane of the shackle. More particularly, and as distinguished from the last embodiment, a main body 42 is provided with an internal bore having a thread complimental to an outer annular thread of a lock bolt body 42. Openings within the main body receive the shackle 41 having at least one arcuate cutaway oriented to face the other leg of the shackle, whereby axial advancement or retraction of the lock bolt body 44 can engage the arcuate cutaway 41a thereby freeing or locking the shackle legs.

Figure 23:
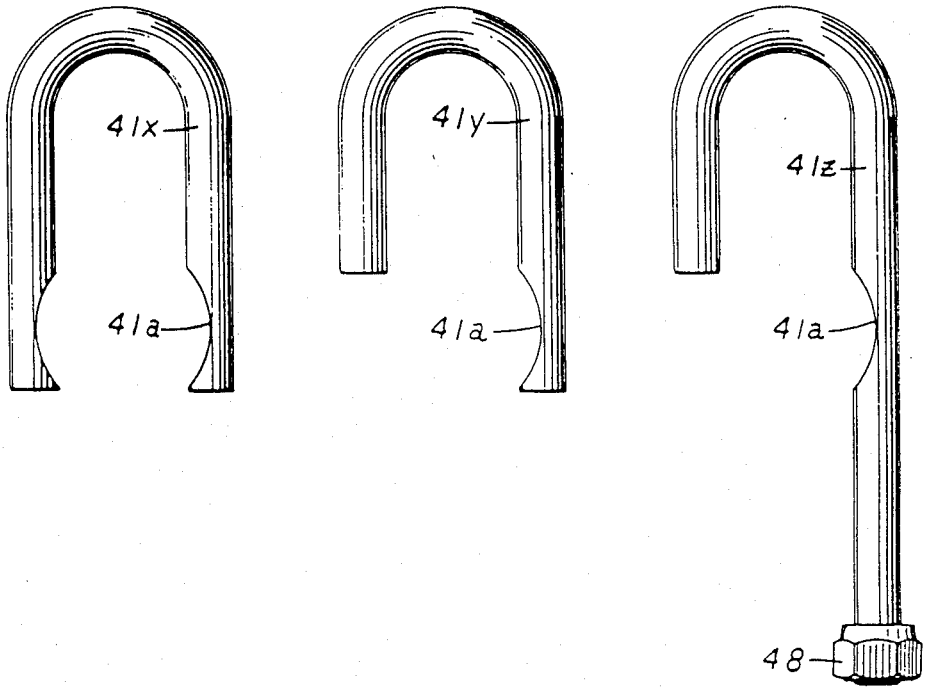
FIG. 23 shows possible embodiments of different shackle legs for the third and fourth embodiments.

The variations in shackle leg configuration shown in FIG. 23 also include a lock nut 38 on a free end of the longer leg of the shackle 41 which precludes disassembly of the shackle leg 41 from the main body 42 in most circumstances. The three embodiments in FIG. 23 show respectively a shackle 41x first and second legs of equal length each having an arcuate cutaway 41a facing each other, an embodiment 41y with a short leg and a longer leg, the longer leg having the arcuate cutaway 41a facing the shorter leg and a shackle 41z similar to 41y with the longer leg extended even further to support at a threaded end thereof the lock nut 48.

Moreover, having thus described the invention, it should be apparent that numerous structural modifications and adaptations may be resorted to without departing from the scope and fair meaning of the invention as set forth hereinabove and as defined hereinbelow by the claims.

I claim:

1. A padlock comprising, in combination:

a shackle having a generally U-shaped configuration with one short leg and one long leg;

the long leg having a free end, said long leg having at the free end thereof an arcuate notch formed on said long leg, the short leg having an arcuate notch formed therein oriented facing the arcuate notch formed on the long leg;

a padlock main body having an opening therein to receive said shackle long leg and another opening therein to receive the shackle short leg; and lock means within said main body to engage and lock the short leg at said arcuate notch thereof and to engage said long leg at the arcuate notch thereof, thereby locking said leg and said short leg.

2. The padlock of claim 1, wherein said padlock main body is conFIG.d as a blind bore with internal threads to receive said lock means.

3. The padlock of claim 2, wherein said shackle legs define a plane oriented, such that axial movement of the said lock means is perpendicular thereto.

4. The padlock of claim 3, wherein said lock means engages both of the shackle legs.

5. In a padlock having a shackle with a pair of legs, the improvement comprising:

a main body which defines means for receiving the shackle legs;

the shackle legs being positioned on a vertical plane; and an internal thread on said main body to receive a threaded lock bolt body therein, said lock bolt body having a one side portion and a second side portion, said lock bolt body further having means to fixedly retain a respective shackle leg to each of the said one and second side portions when said lock bolt body is axially advanced by rotation of said lock bolt body with respect to said threads on said main body in a direction being perpendicular to the plane on which the shackle legs are positioned.

6. The padlock of claim 5, wherein each of the shackle legs includes at least one arcuate notch which engages a respective side portion of said lock bolt body;

said respective side portions of the lock bolt body having a substantially annular outer surface to be received in a respective arcuate notch of each respective shackle leg when the lock bolt body is axially advanced in the direction being perpendicular to the plane on which the shackle legs are positioned, thereby securing said padlock.

7. The padlock of claim 5, wherein the internal thread is embodied as an internal thread on a bore of the main body, and the lock bolt body has an external thread complemental thereto.

8. The padlock of claim 7, wherein the lock bolt body has a coded socket to drive said body.

9. The padlock of claim 6, wherein the lock bolt body has a coded socket to drive said body.

10. In a padlock having a shackle with a pair of legs, the improvement comprising:

a main body which defines means for receiving the shackle legs;

the shackle legs being positioned on a substantially vertical plane, one of said shackle legs having a substantially arcuate notch formed therein; and an internal thread on said main body to receive a threaded lock bolt body therein, said lock bolt body having a side portion, said side portion being substantially arcuate in shape to be received in the arcuate notch for fixedly retaining the respective shackle leg to said side portion when said lock bolt body is axially advanced by rotation of said lock bolt body with respect to said threads on said main body in a direction perpendicular to the plane on which the shackle legs are positioned.

* * * * *